US006589081B2

(12) United States Patent
Kukita et al.

(10) Patent No.: US 6,589,081 B2
(45) Date of Patent: Jul. 8, 2003

(54) ELECTRICAL CONNECTOR

(75) Inventors: Hiroaki Kukita, Yokohama (JP); Hirofumi Yamagata, Yokohama (JP)

(73) Assignee: J.S.T. Mfg. Co., Ltd., Osaka (JP)

( * ) Notice: Subject to any disclaimer, the term of this patent is extended or adjusted under 35 U.S.C. 154(b) by 0 days.

(21) Appl. No.: 10/085,295

(22) Filed: Feb. 28, 2002

(65) Prior Publication Data

US 2002/0132531 A1 Sep. 19, 2002

(30) Foreign Application Priority Data

Mar. 19, 2001 (JP) ..... 2001-077654

(51) Int. Cl.[7] ..... H01R 24/00
(52) U.S. Cl. ..... 439/660; 439/608
(58) Field of Search ..... 439/660, 608, 439/108, 607, 609, 610

(56) References Cited

U.S. PATENT DOCUMENTS 4,886,463 A 12/1989 Scott et al. ..... 439/89
5,045,977 A 9/1991 Cesar ..... 361/424
5,611,700 A * 3/1997 Mitra ..... 439/101
5,795,191 A * 8/1998 Preputnick et al. ..... 439/608
RE35,896 E * 9/1998 Brunker et al. ..... 439/108
5,813,871 A * 9/1998 Grabbe et al. ..... 439/108
6,129,586 A * 10/2000 Bellemon ..... 439/607

FOREIGN PATENT DOCUMENTS

DE 3030805 A1 3/1982

OTHER PUBLICATIONS

European Search Report, dated May 23, 2002, 3 pages.

* cited by examiner

*Primary Examiner*—Ross Gushi
(74) *Attorney, Agent, or Firm*—Rosenthal & Osha L.L.P.

(57) ABSTRACT

A contact 24 and a conductor plate 26, 27 are held in the housing 21 so that portions of the contact 24 except its end portion 24*a* and the plate 26, 27 can be put in a parallel relation to each other. Also, a contact 34 is held in the housing 31 so that when the connector 2 and 3 are fitted to each other, portions of the contact 34 except its end portion 34*a* and the plate 26, 27 can be put in a parallel relation with each other. Further, the end portions 24*a* and 34*a* are so shaped that the distance between the signal line formed by the contacts 24 and 34 and the plate 26, 27 can be kept substantially uniform. This can provide a stabilized impedance of the signal line formed by the contacts being contacted with each other.

5 Claims, 5 Drawing Sheets

ELECTRICAL CONNECTOR

BACKGROUND OF THE INVENTION

The present invention relates to an electrical connector for electrically interconnecting two boards or equivalent.

In recent years, with increase in the number of input and output lines, such as signal lines and electric power lines, to the boards built in electrical equipment such as computers, multicore electrical connectors are often used as a board-to-board electrical connector for interconnecting the two boards. In addition, since fast signals may be included in the input and output to and from the boards, some of the electrical connectors take measurements against noises through the use of the transmission line structure formed by the signal lines and the ground planes.

In the electrical connector having a pair of male and female connectors for instance, the pair of male and female connectors are each provided with terminals having contacts for signal line and for conductor plates for ground plane. When the terminals of one connector and the related terminals of the other connector are fitted to each other, the contacts of the terminals of the respective connectors are brought into contact with each other to form the signal lines and also the conductor plates are brought into contact with each other to form the ground planes.

However, this conventional type of electrical connector has a disadvantage that the distances between the signal lines and the ground planes undergo drastic changes in the region where the respective contacts are brought into contact with each other and the respective conductor plates are brought into contact with each other. If the distances between the signal lines and the ground planes in the transmission lines undergo drastic changes, then the impedances of the transmission lines will not be kept stable, i.e., the impedance characteristics will be varied by the frequencies. If the impedances of the transmission lines are not kept stable, then there will arise the problem that even when the electrical connector is designed to produce a desired impedance at a certain frequency, the electrical connector thus designed will not produce the desired impedance at different frequencies from the certain frequency and, as a result, losses will increase at the different frequencies.

It is the object of the present invention to provide an electrical connector that can provide stabilized impedances of transmission lines in the electrical connector.

BRIEF SUMMARY OF THE INVENTION

An electrical connector of the present invention comprises a first connector having a first contact; and a second connector having a second contact which is brought into contact with the first contact when the second connector is fitted to the first connector, wherein a conductor plate, which extends in a substantially parallel relation to the first contact and the second contact when the first connector and the second connector are fitted to each other, is provided in at lease either of the first connector and the second connector; and wherein an end portion of the first contact and an end portion of the second contact, which are to be contacted with each other, are so shaped that the distance between the contact portions of the first and second contacts and the conductor plate can be made substantially equal to the distance between portions of the first and second contacts except their contact portions and the conductor plate.

According to the electrical connector thus constructed, since the end portion of the first contact and the end portion of the second contact which are to be contacted with each other are so shaped that the distance between the contact portions of the first and second contacts and the conductor plate can be made substantially equal to the distance between portions of the first and second contacts except their contact portions and the conductor plate, the distance between the signal line formed by the first and second contacts being contacted with each other when the first connector and the second connector are fitted to each other and the conductor plate (the ground plane) can be kept substantially uniform. As a result of this, the impedance of the transmission line can be stabilized.

In the electrical connector mentioned above, the first connector is provided with two first contacts which are put in a parallel relation with each other and spaced at a substantially equal distance to the conductor plate when the first connector and the second connector are fitted to each other, and wherein the second connector is provided with two second contacts which are put in a parallel relation with each other and spaced at a substantially equal distance to the conductor plate when the first connector and the second connector are fitted to each other.

According to the electrical connector thus constructed, since the two signal lines are formed which are put in a parallel relation with the ground plane (the conductor plate) and spaced at a substantially equal distance to the ground plane, transmission of differential signals can be provided.

In the electrical connector mentioned above, a plurality of conductor plates provided in at least either of the first connector and the second connector are spaced in a confronting relation to each other; the first connector is provided with one or more first contacts which are placed between each pair of conductor plates when the first connector and the second connector are fitted to each other; and the second connector is provided with one or more second contacts which are placed between each pair of conductor plates when the first connector and the second connector are fitted to each other.

According to the electrical connector thus constructed, since the conductor plate is placed between each pair of the signal lines formed by the first and second contacts being contacted with each other, the signals transmitted through the respective signal lines can be prevented from interfering with each other.

DETAILED DESCRIPTION OF THE PREFERRED EMBODIMENTS

In the following, a certain preferred embodiment of the present invention will be described with reference to the accompanying drawings.

Figure 1:
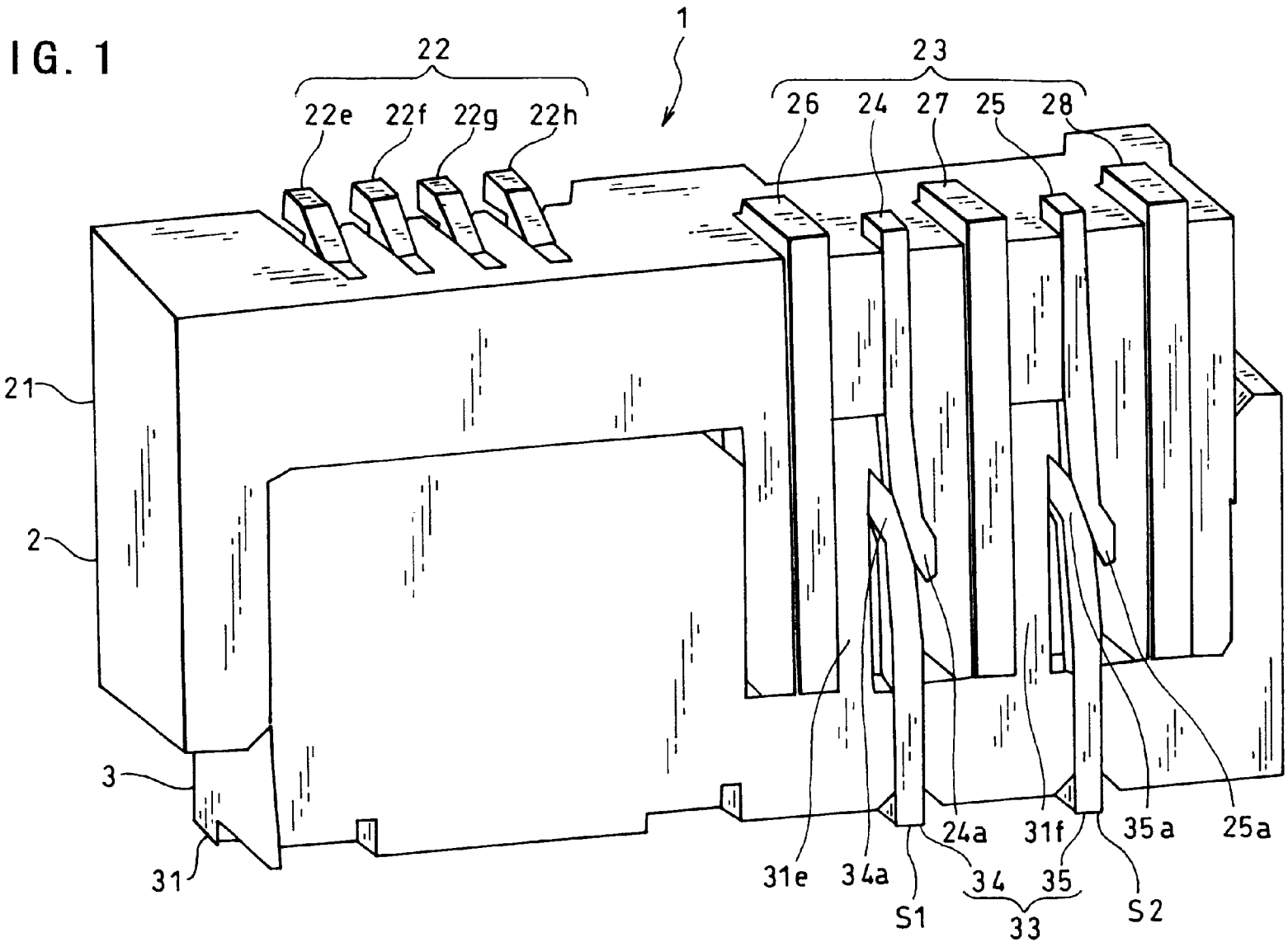
FIG. 1 is a perspective view in section of an electrical connector of the invention.
Figure 2:
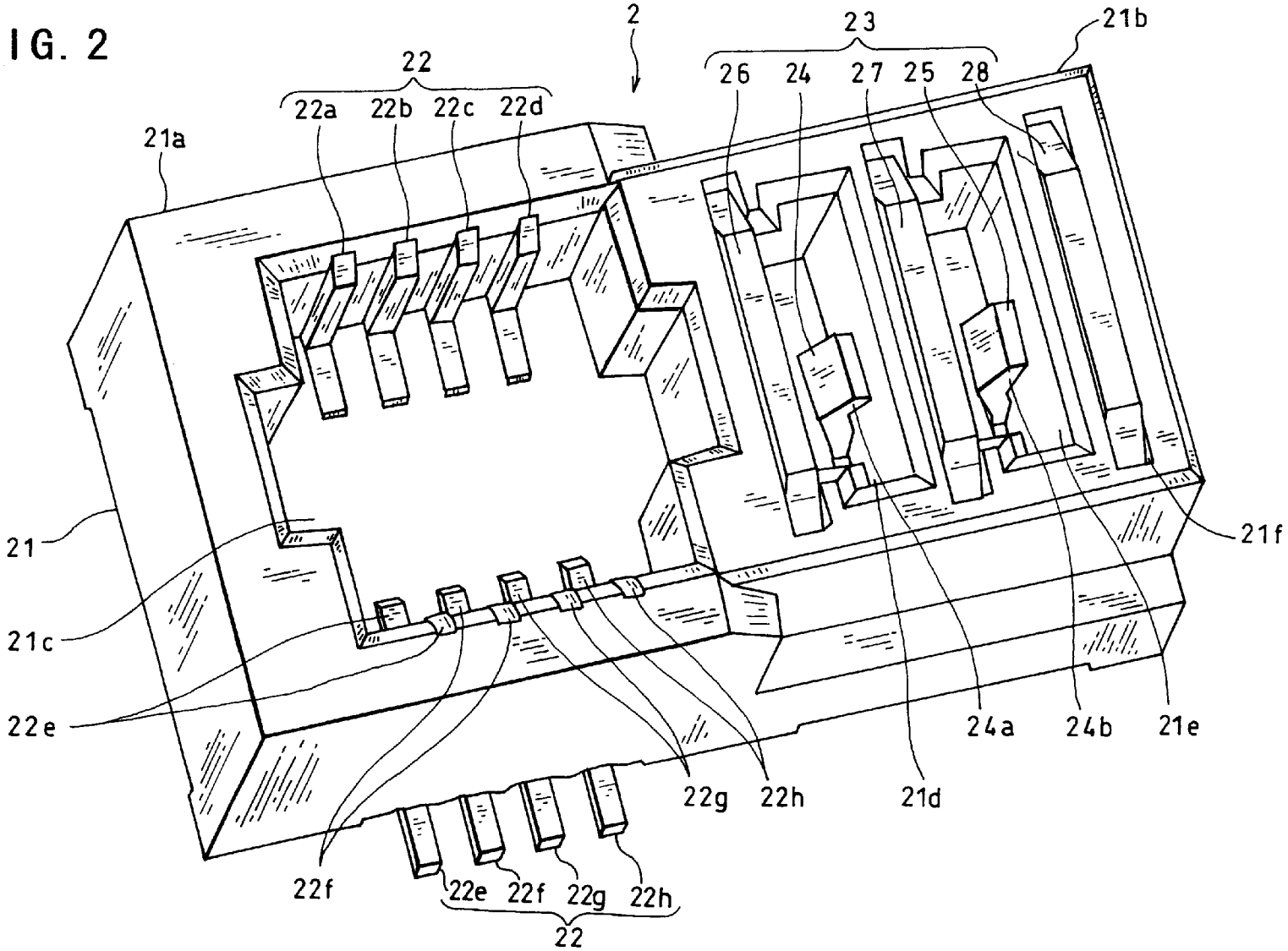
FIG. 2 is a perspective view of one connector of the electrical connector of which perspective view in section is shown in FIG. 1.
Figure 3:
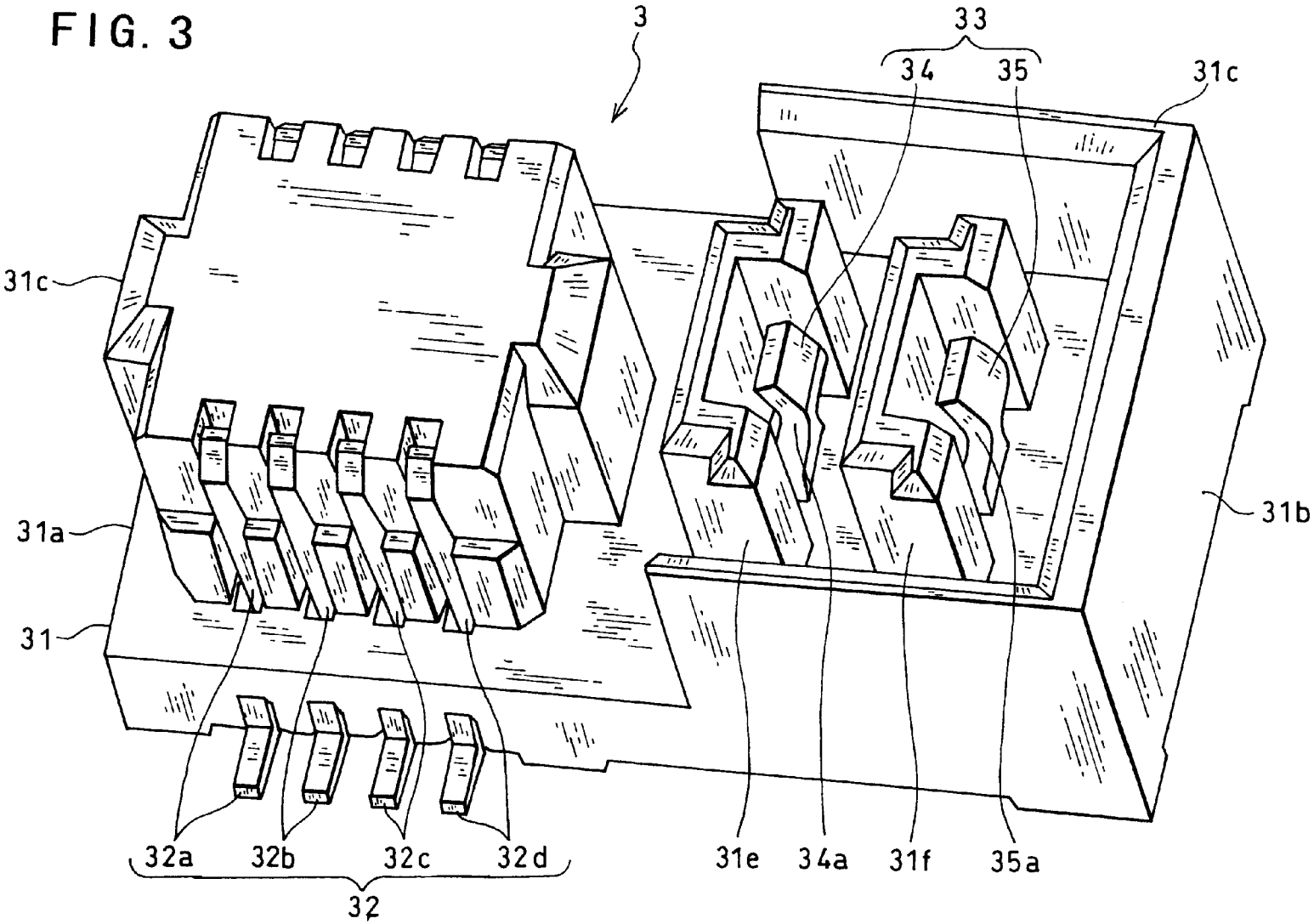
FIG. 3 is a perspective view of the other connector of the electrical connector of which perspective view in section is shown in FIG. 1.

An electrical connector 1 according to the embodiment shown in FIGS. 1–3 comprises a pair of male and female connectors 3 and 2.

The connector 2 comprises a housing 21, a group of terminals 22 mainly used for slow signals, and a group of terminals 23 mainly used for fast signals, as shown in FIG. 2.

The housing 21 is formed in one piece which comprises a terminal-group holding portion 21*a* for holding the group of terminals 22 and a terminal-group holding portion 21*b* for holding the group of terminals 23. The terminal-group holding portion 21*a* has a concave portion 21*c* formed therein. On the other hand, the terminal-group holding portion 21*b* has three concave portions 21*d*, 21*e* and 21*f* formed therein.

The group of terminals 22 comprises a total of eight contacts 22*a*, 22*b*, 22*c*, 22*d*, 22*e*, 22*f*, 22*g* and 22*h* which are identical in shape and are aligned in two columns and four rows. The group of terminals 22 is held in the concave portion 21*c* provided in the terminal-group holding portion 21*a* of the housing 21.

The group of terminals 23 is held in the terminal-group holding portion 21*b* of the housing 21 and comprises two contacts 24 and 25 and three conductor plates 26, 27 and 28.

The contact 24 is a conductor having an end portion 24*a* which is shaped to extend toward the conductor plate 26, first, and then extend away therefrom, as mentioned later. The contact 24 is held in the housing 21 so as to be accommodated in the concave portion 21*d* provided in the terminal-group holding portion 21*b*.

The contact 25 is a conductor having an end portion 25*a* identical in shape to the end portion 24*a* of the contact 24. The contact 25 is held in the housing 21 so as to be accommodated in the concave portion 21*e* provided in the terminal-group holding portion 21*b* and to extend in a parallel relation with the contact 24.

When the connector 2 and the connector 3 are fitted to each other, the end portion 24*a* of the contact 24 and the end portion 25*a* of the contact 25 are brought into contact with an end portion 34*a* of a contact 34 mentioned later and an end portion 35*a* of a contact 35 mentioned later, respectively, to form signal lines S1 and S2 through which signals are transmitted from a printed circuit board (not shown) mounting the connector 2 thereon to a printed circuit board (not shown) mounting the connector 3 thereon or vice versa, as shown in FIG. 1.

The conductor plates 26, 27 and 28, which are to form the ground planes, have a flat-plate form. The conductor plate 26 is held in the housing 21 so as to be accommodated in the concave portion 21*d* provided in the terminal-group holding portion 21*b* and to extend in a parallel relation with portions of the contact 24 except it's end portion 24*a*. The conductor plate 27 is held in the housing 21 so as to be accommodated in the concave portion 21*e* provided in the terminal-group holding portion 21*b* and to extend in a parallel relation with portions of the contact 25 except its end portion 25*a*. Further, the conductor plate 28 is held in the housing 21 so as to be accommodated in the concave portion 21*f* provided in the terminal-group holding portion 21*c* and to extend in a parallel relation with the conductor plates 26 and 27.

As a result of the contacts 24 and 25 and the conductor plates 26, 27 and 28 being held in the housing 21 in the manner mentioned above, the portions of the contact 24 except its end portion 24*a*, the portions of the contact 25 except its end portion 25*a* and the conductor plates 26, 27 and 28 are aligned to extend in parallel with each other.

The connector 3 comprises a housing 31, a group of terminals 32 mainly used for slow signals, and a group of terminals 33 mainly used for fast signals, as shown in FIG. 3.

The housing 31 is formed in one piece which comprises a terminal-group holding portion 31*a* for holding the group of terminals 32 and a terminal-group holding portion 31*b* for holding the group of terminals 33. The terminal-group holding portion 31*a* has a convex portion 31*c* formed therein. On the other hand, the terminal-group holding portion 31*b* has a frame portion 31*d*, and projecting portions 31*e* and 31*f* provided in the terminal-group holding potion 31*b*.

The group of terminals 32 comprises a total of eight contacts 32*a*, 32*b*, 32*c*, 32*d*, 32*e*, 32*f*, 32*g* and 32*h* which are identical in shape and are aligned in two columns and four rows. The group of terminals 32 is held in side surfaces of the convex portion 31*c* provided in the terminal-group holding portion 31*a* of the housing 31.

The group of terminals 33 is held in the terminal-group holding portion 31*b* of the housing 31 and comprises two contacts 34 and 35.

The contact 34 is a conductor having an end portion 34*a* which is shaped to extend away from the projecting portion 31*e* provided in the housing 31, first, and then extend toward it. The contact 34 is held in the housing 31 to be placed in between the projecting portions 31*e* and 31*f* provided in the terminal-group holding portion 31*b* so that when the connectors 2 and 3 are fitted to each other, the contact 34 can extend in parallel with the conductor plate 26 of the connector 2 and also the distance between the portions of the contact 34 except its end portion 34*a* and the conductor plate 26 of the connector 2 can be made substantially equal to the distance between the portions of the contact 24 except its end portion 24*a* and the conductor plate 26.

The contact 35 has an end portion 35*a* identical in shape to the end portion 34*a* of the contact 34. The contact 35 is held in the housing to be placed in the opposite side to the projecting portion 31*e* with respect to the projecting portion 31*f* provided in the terminal-group holding portion 31*b* so that when the connectors 2 and 3 are fitted to each other, the contact 35 can extend in parallel with the conductor plate 27 of the connector 2 and also the distance between the portions of the contact 35 except its end portion 35*a* and the conductor plate 27 of the connector 2 can be made substantially equal to the distance between the portions of the contact 25 except its end portion 25*a* and the conductor plate 27. It should be noted that the contacts 34 and 35 may be made to be identical to the contacts 24 and 25 of the connector 2, in order to reduce the production costs.

When the connector 2 and the connector 3 are fitted to each other, the end portion 34*a* of the contact 34 is brought into contact with the end portion 24*a* of the contact 24, to form the signal line S1, and the end portion 35*a* of a contact 35 is brought into contact with the end portion 25*a* of the contact 25 of the connector 2, to form the signal line S2.

In the following, reference is given to the fitting of the connectors 2 and 3.

The convex portion 31*c* provided in the housing 31 of the connector 3 is accommodated in the concave portion 21*c* provided in the terminal-group holding portion 21 of the connector 2, such that the group of terminals 22 of the connector 2 and the group of terminals 32 of the connector 3 are brought into contact with each other.

The terminal-group holding portion 21*b* of the connector 2 is accommodated in the frame portion 31*d* of the terminal-group holding portion 31*b* of the connector 3. Then, the projecting portion 31*e* provided in the housing 31 of the connector 3 and the contact 34 of the connector 3 are accommodated in the concave portion 21*d* provided in the terminal-group holding portion 21*b* of the connector 2 so that they can be placed between the conductor plate 26 and contact 24 of the connector 2. As a result of this, the end portion 24*a* of the contact 24 of the connector 2 and the end portion 34*a* of the contact 34 of the connector 3 are brought into contact with each other. The projecting portion 31*f* provided in the housing 31 of the connector 3 and the contact 35 of the connector 3 are accommodated in the concave portion 21*e* provided in the terminal-group holding portion 21*b* of the connector 2 so that they can be placed between the conductor plate 27 and contact 25 of the connector 2. As a result of this, the end portion 25*a* of the contact 25 of the connector 2 and the end portion 35*a* of the contact 35 of the connector 3 are brought into contact with each other.

In the following, reference is given to the shape of the contact 24 of the connector 2 and of the contact 34 of the connector 3.

The end portion 24*a* of the contact 24 and the end portion 34*a* of the contact 34 are so shaped that when the connectors 2 and 3 are fitted to each other, the distance between the signal line S1 and the conductor plate 26 and the distance between the signal line S1 and the conductor plate 27 are kept substantially uniform. It should be noted that what is intended to be meant by the phrase that "the distance between the signal line S1 and the conductor plate 26 and the distance between the signal line S1 and the conductor plate 27 are kept substantially uniform" is that even if the distances undergo changes, such changes are the degree to which the impedance of the transmission line formed by the signal line S1 and the ground planes (the conductor plates 26 and 27) is kept at a stable level.

Figure 4:
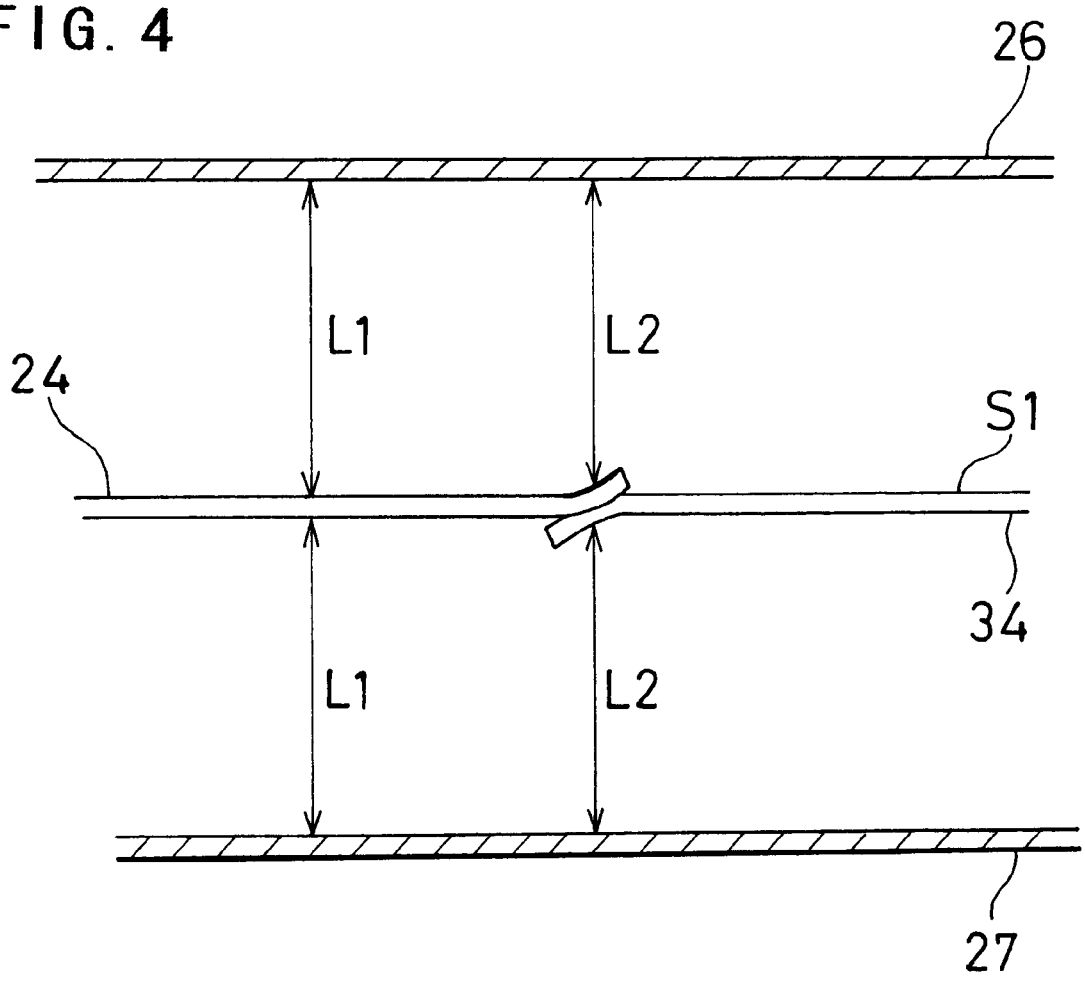
FIG. 4 is a diagram illustrating the distance relation between the signal line and the ground planes.

For example, as shown in FIG. 4, the end portion 24*a* of the contact 24 and the end portion 34*a* of the contact 34 are shaped to satisfy the following relation:

$$Abs(L1-L2)/L1 \leqq 0.2$$

(Preferably, $Abs(L1-L2)/L1 \leqq 0.1$)

(Further preferably, $Abs(L1-L2)/L1 \leqq 0.05$)

where L1 is the distance between the signal line S1, except its part where the contacts 24 and 34 are in contact with each other, and the conductor plate 26; 27, and L2 is the distance between the signal line S1 at its part where the contacts 24 and 34 are in contact with each other and the conductor plate 26; 27. It is to be noted that Abs(L1−L2) represents the absolute value of a value obtained by subtracting L2 from L1.

Also, the contact 24 of the connector 2 and the contact 35 of the connector 3 are shaped to form substantially the same relation as the contact 24 of the connector 2 and the contact 34 of the connector 3 relate to each other.

According to the electrical connector of the present invention described above, since the end portion 24*a* of the contact 24, the end portion 25*a* of the contact 25, the end portion 34*a* of the contact 34, and the end portion 35*a* of the contact 35 are shaped as mentioned above, the distance between the signal line S1 and the ground planes (the conductor plates 26, 27) and the distance between the signal line S2 and the ground planes (the conductor plates 27, 28) are each kept substantially uniform and thus the impedance of the transmission line is stabilized. As a result of this, when the electrical connector is designed to produce a desired impedance at a certain frequency, it can also produce the desired impedance at different frequencies from the certain frequency, and as such can avoid increase of losses at the different frequencies from the designed frequency caused by the impedance being kept unstable.

In addition, since the conductor plate 27 is placed between the signal line S1 formed by the contacts 24 and 34 being contacted with each other and the signal line S2 formed by the contacts 25 and 35 being contacted with each other, the signals transmitted through the respective signal lines can be prevented from interfering with each other.

While the preferred embodiment of the present invention has been illustrated above, it will be understood that the present invention should not be limited to the embodiment illustrated above and various changes and modifications in design may be made in the invention within the scope of the claims. For example, while the two fast-signal signal lines are formed in the embodiment illustrated above, any adequate number of signal lines may selectively be formed. Also, the conductor plates 26, 27 and 28 may be provided in the connector 3, rather than in the connector 2. Alternatively, the conductor plates may be provided in both of the connectors 2 and 3 so that when the connectors 2 and 3 are fitted to each other, the conductor plates provided in the both of the connectors 2 and 3 can be brought into contact with each other to form the ground planes.

Figure 5:
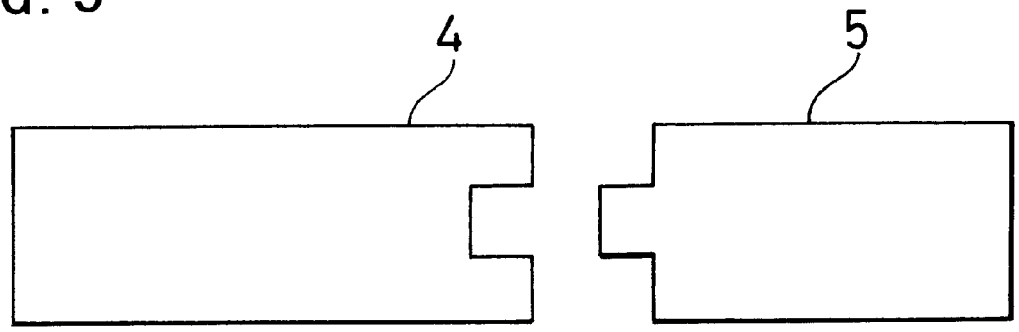
FIG. 5 is a rough sketch showing the contacts of another form.

In addition, as long as the end portions of the contacts are so shaped that when the connectors 2 and 3 are fitted to each other, the distance between the signal line S1 formed by the contact 24 of the connector 2 and the contact 34 of the connector 3 and the ground planes (the conductor plates) and the distance between the signal line S2 formed by the contact 25 of the connector 2 and the contact 35 of the connector 3 and the ground planes (the conductor plates) are each kept substantially uniform, no particular limitation is imposed on the shape of the end portions of the contacts. For example, a pair of contacts 4 and 5 may be formed into a complementary shape, as shown in FIG. 5.

Further, instead of the structure wherein a single contact is held between each pair of conductor plates, two contacts aligned in parallel with each other at a substantially equal distance to the conductor plates may alternatively be held therebetween. This alternation can provide an advantage of enabling the transmission of differential signals.

Further, it is needless to say that the present invention is applicable to various types of electrical connectors as well as to the board-to-board electrical connector.

What is claimed is:

1. An electrical connector comprising:

a first connector having a first contact; and a second connector having a second contact which is brought into contact with the first contact when the second connector is fitted to the first connector, wherein the first contact and the second contact are positioned on a substantially straight line when the first connector and the second connector are fitted to each other, wherein a conductor plate, which extends in a substantially parallel relation to the first contact and the second contact when the first connector and the second connector are fitted to each other, is provided in at least either of the first connector and the second connector; and wherein an end portion of the first contact and an end portion of the second contact, which are to be contacted with each other, are so shaped that the distance between the contact portions of the first and second contacts and the conductor plate can be made substantially equal to the distance between portions of the first and second contacts except their contact portions and the conductor plate.

2. The electrical connector according to claim 1, wherein the first connector is provided with two first contacts which are put in parallel relation with each other and spaced at a substantially equal distance to the conductor plate when the first connector and the second connector are fitted to each other, and wherein the second connector is provided with two second contacts which are put in parallel relation with each other and spaced at a substantially equal distance to the conductor plate when the first connector and the second connector are fitted to each other.

3. The electrical connector according to claim 1, wherein a plurality of conductor plates provided in at least either of the first connector and the second conductor are spaced in a confronting relation to each other;

wherein the first connector is provided with one or more first contacts which are placed between each pair of conductor plates when the first connector and the second connector are fitted to each other; and wherein the second connector is provided with one or more second contacts which is/are placed between each pair of conductor plates when the first connector and the second connected are fitted to each other.

4. The electrical connector according to claim 1, wherein each of the first contact, the second contact, and the conductor plate has a planar shape and is placed in substantially parallel relation to each other, and wherein a plurality of conductor plates provided in at least either of the first connector and the second connector are spaced in a confronting relation to each other and arranged in a direction in which a plurality of pair of the first and second contacts are arranged.

5. The electrical connector according to claim 1, wherein a plurality of conductor plates provided in at least either of the first connector and the second connector are spaced in a confronting relation to each other and arranged in a direction in which a plurality of pair of the first and second contacts are arranged.

* * * * *